US005445370A

United States Patent [19]

Soga

[11] Patent Number: 5,445,370

[45] Date of Patent: Aug. 29, 1995

[54] SHEET FEEDING DEVICE

[75] Inventor: Norikazu Soga, Minamiashigara, Japan

[73] Assignee: Fuji Photo Film Co., Ltd., Kanagawa, Japan

[21] Appl. No.: 319,091

[22] Filed: Oct. 6, 1994

Related U.S. Application Data

[63] Continuation of Ser. No. 800,111, Nov. 29, 1991, abandoned.

[30] Foreign Application Priority Data

Dec. 14, 1990 [JP] Japan ..... 2-402469
Dec. 14, 1990 [JP] Japan ..... 2-402471

[51] Int. Cl.[6] ..... B65H 5/08

[52] U.S. Cl. ..... 271/12; 271/107; 271/270; 271/902

[58] Field of Search ..... 271/5, 12, 107, 202, 271/270, 902

[56] References Cited

U.S. PATENT DOCUMENTS

| | | | |
|---|---|---|---|
| 2,183,293 | 12/1939 | Leach | 271/103 |
| 4,331,328 | 5/1982 | Fasig | 271/270 |
| 4,634,263 | 1/1987 | Miwa | 271/270 X |
| 5,073,802 | 12/1991 | Sugiyama | 271/270 X |
| 5,104,110 | 4/1992 | Haibara | 271/270 X |
| 5,127,645 | 7/1992 | Torisawa | 271/107 X |

FOREIGN PATENT DOCUMENTS

| | | |
|---|---|---|
| 59-82235 | 5/1984 | Japan . |
| 62-205940 | 9/1987 | Japan . |
| 1-242340 | 3/1988 | Japan . |

*Primary Examiner*—H. Grant Skaggs
*Assistant Examiner*—Carol L. Druzbick
*Attorney, Agent, or Firm*—Sughrue, Mion, Zinn, Macpeak & Seas

[57] ABSTRACT

Disclosed herein is a device for feeding sheets, one by one, from a stack of sheets. The sheet feeding device basically comprises a suction cup or pad which is used to attract and hold an uppermost one of stacked sheets for thereby taking out the uppermost sheet from the stacked sheets and which is swingable at a given angular range, a delivery mechanism for receiving the uppermost sheet from the suction pad for deliverying the same to a succeeding device, a drive source for swinging the suction pad, and a control circuit for swinging the suction pad at, at least, either a first angular velocity or a second angular velocity which is lower than the first angular velocity and is used to deliver the uppermost sheet to the delivery mechanism. The sheet conveying speed the delivery mechanism to the succeeding device can accurately be adjusted so as to match with the actual sheet conveying speed of the succeeding device.

5 Claims, 6 Drawing Sheets

SHEET FEEDING DEVICE

This is a continuation of application Ser. No. 07/800,111 filed Nov. 29, 1991, now abandoned.

BACKGROUND OF THE INVENTION

1. Field of the Invention

The present invention relates to a sheet feeding device for feeding an uppermost sheet of a stack of sheets which is attracted under suction by a suction cup or pad to a delivery mechanism to deliver the uppermost sheet to a next station.

2. Description of the Related Art

In order to deliver sheets such as unexposed photographic light-sensitive mediums which have been stacked and accommodated, to an exposure station or to deliver sheets after images have been exposed thereon to a developing machine, there is employed a sheet feeding device for taking out the sheets one by one so as to deliver to a desired station.

In the sheet feeding device, stacked sheets are first loaded in a given sheet placement position in a supply magazine. Thereafter, an uppermost sheet of stacked sheets is attracted under suction by a suction cup or pad (separating means) so as to withdraw from the sheet placement position. The uppermost sheet thus withdrawn is delivered from the suction pad to a delivery mechanism, from which the sheet is supplied to an exposure device, an automatic photographic processors, etc.

A detector is disposed in a stop position corresponding to a sheet delivery position, of the suction pad. Alternatively, there is disposed an arrangement for mechanically stopping the suction pad from moving. Under this condition, the uppermost sheet, which has been attracted and held under suction by the suction pad, is fed to the stop position at a uniform speed or at a uniform angular velocity, followed by delivery of the sheet to the delivery mechanism.

There is now demand for carrying out a sheet feeding process at a high speed. In order to meet this demand, it is necessary to move the suction pad with the uppermost sheet attracted thereto to its stop position at a high speed. It is, however, hard to reliably stop the suction pad while being moved at a high speed at its stop position. The suction pad tends to move beyond the stop position. Therefore, the uppermost sheet is subjected to scratches and fog under pressure when it is inserted between a pair of rollers serving as a delivery mechanism.

In the sheet feeding device, when the delivery mechanism receives the uppermost sheet from the suction pad, the delivery mechanism comprising a pair of delivery rollers, a drum, delivery belts, etc. is driven synchronism with a travel speed of the suction pad. In addition, the delivery mechanism is activated in synchronism with sheet conveying speeds of an exposure device or an automatic photographic processor, etc. when the uppermost sheet is delivered to the exposure device, the automatic photographic processor, etc. from the delivery mechanism.

A drive mechanism of the sheet feeding device is normally activated by an induction motor, and its rotational speed is adjusted in analog form by operating a control knob or the like of a speed controller electrically connected to the induction motor. In particular, when the sheet conveying speed of the succeeding station such as the exposure device, the automatic photographic processor, etc. ranges from a relatively low speed to a high speed, it is, however, very hard to adjust the sheet delivery speed in analog form so as to meet the conveying speed of the succeeding station, because the rotational speed of the induction motor is adjusted in analog form as described above. There are often situations in which, for example, there is an appreciable difference in sheet (e.g., photographic film) conveying speeds depending on the types of developing machines to be connected or there is an appreciable difference in sheet conveying speeds even in a single developing machine if a gear is replaced.

There is also a slight mechanical difference between the actual sheet conveying speed and the nominal sheet conveying speed of each automatic photographic processor or the like connected as the succeeding station. It is therefore necessary to fine-adjust such a mechanical difference in order to accurately synchronize both speeds with each other.

SUMMARY OF THE INVENTION

It is a principal object of the present invention to provide a sheet feeding device capable of rapidly feeding an uppermost sheet of stacked sheets to a delivery mechanism from a sheet separating means comprising a suction pad and smoothly carrying out a process for delivering the uppermost sheet to the delivery mechanism.

It is another principal object of the present invention to provide a sheet feeding device capable of easily and highly accurately synchronizing a sheet delivery speed with a wide range of sheet conveying speeds of the succeeding station.

It is another object of the present invention to provide a device for feeding sheets, one by one, from a stack of sheets, the device comprising a sheet separating means for attracting and holding an uppermost sheet of a stack of sheets, thereby taking out the uppermost sheet from the stacked sheets, the sheet separating means being swingable in a given angular range, delivering means, for receiving the uppermost sheet from the sheet separating means to deliver the uppermost sheet to a succeeding station, a drive source for swinging the sheet separating means, and controlling means for swinging the sheet separating means at, at least, either a first angular velocity or a second angular velocity lower than the first angular velocity and for delivering the uppermost sheet to the delivering means.

It is a further object of the present invention to provide the device wherein sheet separating means comprises a suction pad connected to a vacuum pump.

It is a still further object of the present invention to provide the device further including driven means for moving the sheet separating means toward and away from the stacked sheets.

It is a still further object of the present invention to provide the device wherein the controlling means comprises a CPU and a memory having a program stored therein for generating pulses for driving a pulse motor as a drive source.

It is a still further object of the present invention to provide the device wherein a dip switch is externally connected to the CPU, the dip switch being used for adjustment of data.

It is a still further object of the present invention to provide a device for feeding sheets, one by one, from a stack of sheets, the device comprising a sheet separating means for attracting and holding an uppermost sheet of a stack of sheets, thereby withdrawing the uppermost sheet from the stacked sheets, the sheet separating means being swingable in a given angular range, delivering means for receiving the uppermost sheet from the feeding means to deliver the uppermost sheet to a following station, a drive source for activating the delivering means, controlling means having memory means for storing a plurality of data of nominal sheet conveying speeds of the succeeding station, and a control circuit for controlling the rotational speed of the drive source, and selecting means for selecting one of the stored nominal sheet conveying speed from the memory means.

It is a still further object of the present invention to provide the device wherein the selecting means is a dip switch.

It is a still further object of the present invention to provide the device further including means for fine-adjusting the nominal sheet conveying speed selected by the selecting means.

It is a still further object of the present invention to provide the device wherein the fine-adjusting means is at least one dip switch.

The above and other objects, features and advantages of the present invention will become apparent from the following description and the appended claims, taken in conjunction with the accompanying drawings in which preferred embodiments of the present invention are shown by way of illustrative example.

DETAILED DESCRIPTION OF THE PREFERRED EMBODIMENTS

Figure 1:
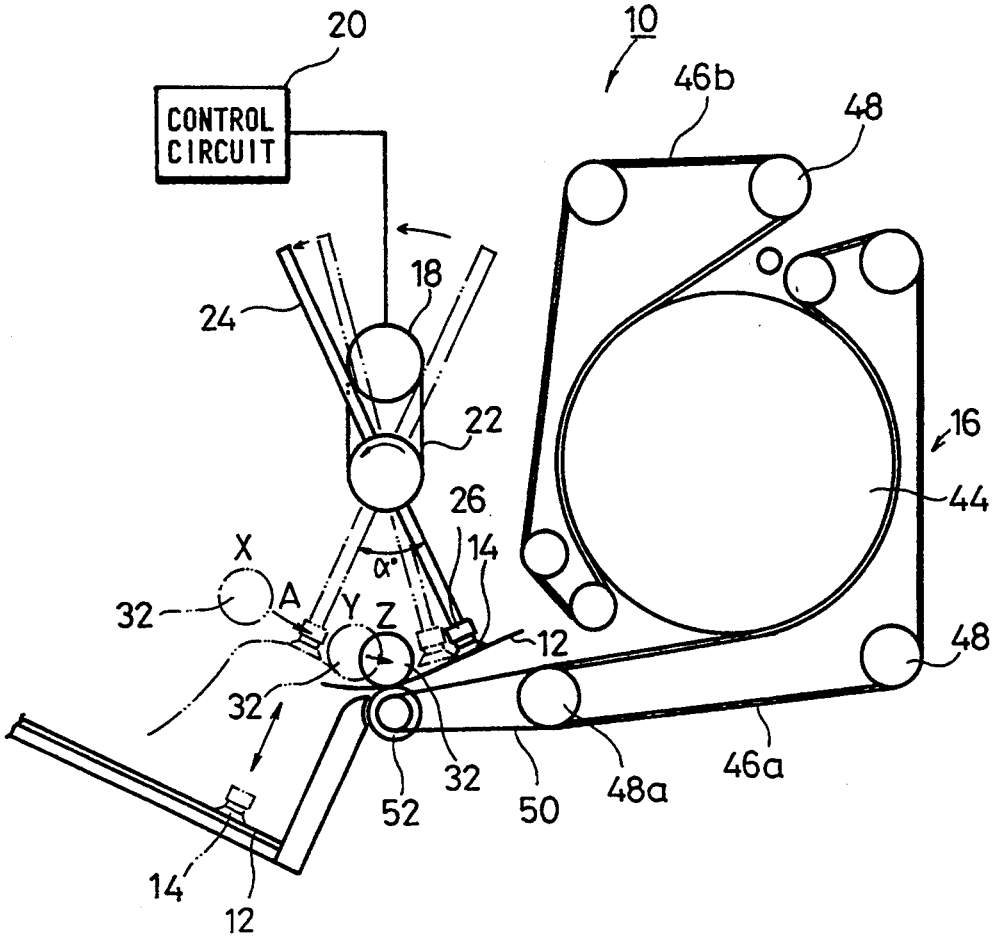
FIG. 1 is a diagram showing an essential part of sheet feeding device according to a first embodiment of the present invention.
Figure 2:
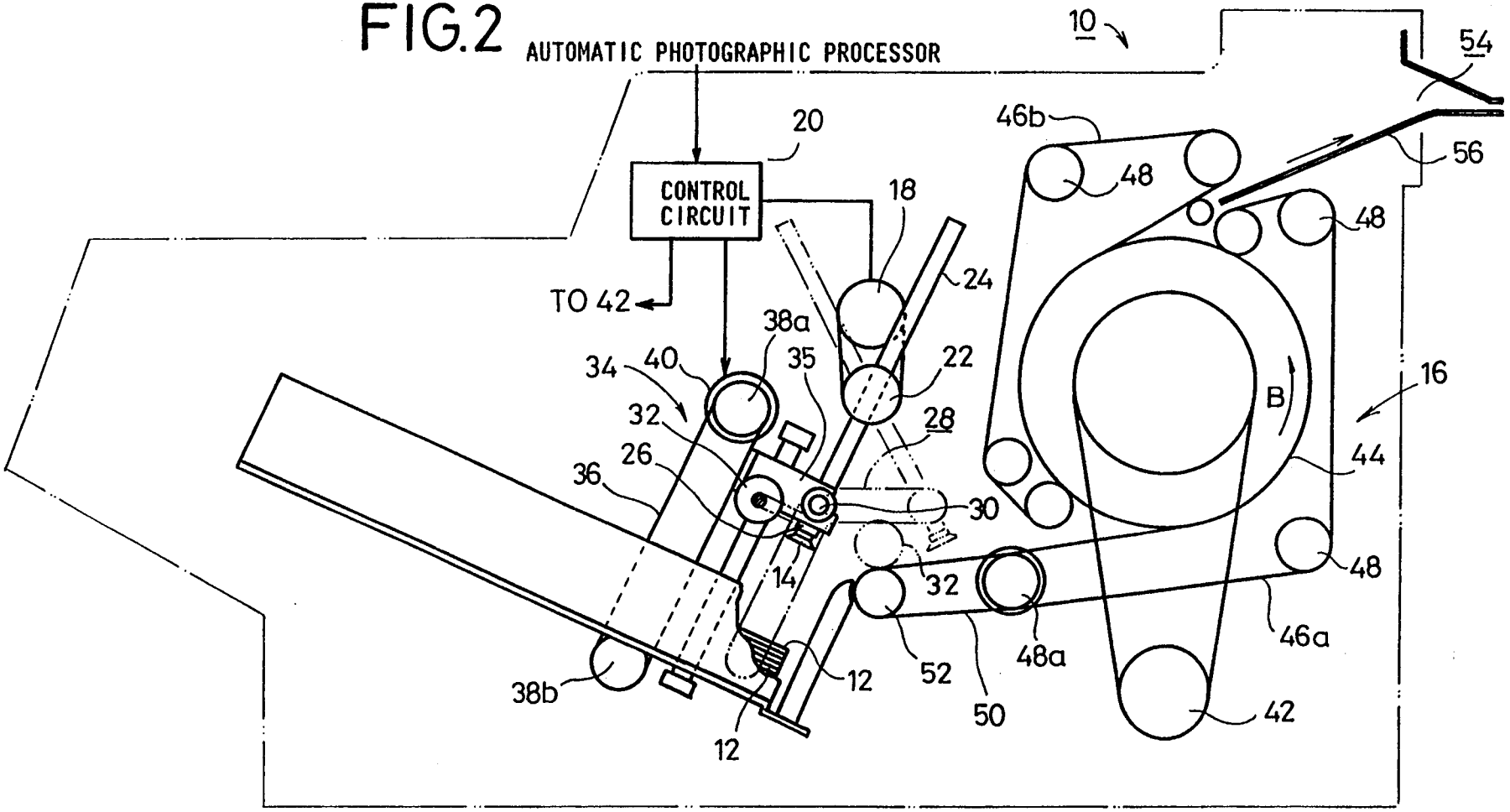
FIG. 2 is a diagram schematically illustrating the structure of the sheet feeding device.

Referring to FIGS. 1 and 2, designated at numeral 10 is a sheet feeding device according to a first embodiment. The sheet feeding device 10 comprises a sheet separating means having suction cup or pad 14 swingable in a given angular range, $\alpha°$, for example, about 50°, for attracting and holding an uppermost sheet of stacked photographic light-sensitive mediums (sheets) 12 on which an image has been exposed so as to be taken from the stack, a delivery mechanism 16 for receiving the uppermost photographic light-sensitive medium 12 thus taken out and for delivering the same to the succeeding station or device, a pulse motor 18 for turning the suction pad 14 in a given angular range, and a control circuit (controlling means) 20 for supplying a drive signal to the pulse motor 18 so as to control the angular velocity (which will be described later) of the suction pad 14.

A rotatable shaft 22 is connected to the pulse motor 18 and has a guide bar 24 which extends therethrough. A holder 26 is fixedly mounted on the guide bar 24 and is provided with a rod 30 to be inserted into a substantially L-shaped guide slot 28. The holder 26 has the suction pad 14 coupled via an unillustrated solenoid controlled valve to a vacuum source, and roller 32 of the delivery mechanism 16. The holder 26 is moved toward and away from the stacked photographic light-sensitive mediums 12 by a drive mechanism 34. The drive mechanism 34 has movable members 35 which engage the both ends of the rod 30 and are fixed to a pair of belts 36. The belts 36 are wound around respective pairs of pulleys **38*a*, 38*b*, with one of the pulleys 38*a* being coupled to a rotative drive source 40**.

The delivery mechanism 16 has a drum 44 having a relatively large diameter, which is rotated by a pulse motor 42. The outer peripheral surface of the drum 44 contacts with a first belt **46*a* and a second belt 46*b*, which are wound around a plurality of rollers 48. A third belt 50 is brought into engagement with a roller 48*a* around which the first belt 46*a* is wound. The uppermost photographic light-sensitive medium 12 is supported on a delivery roller 52 with which the third belt 50 together with the nip roller 32** engage and delivered in the direction indicated arrow A.

The sheet feeding device 10 has a discharge port, i.e., an outlet 54 at the upper rigit portion as viewed in FIG. 2. Each photographic light-sensitive medium 12 delivered from the delivery mechanism 16 guided by a guide plate 56 is fed to an unillustrated automatic photographic processor or the like from the discharge port 54.

Figure 3:
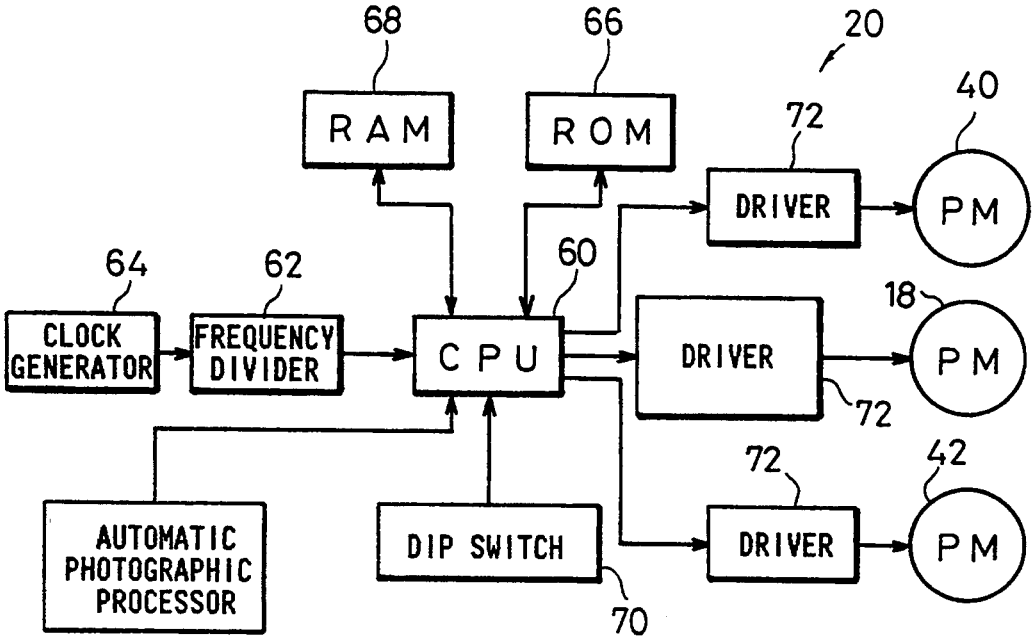
FIG. 3 is a block diagram showing a control circuit of the sheet feeding device.
Figure 4:
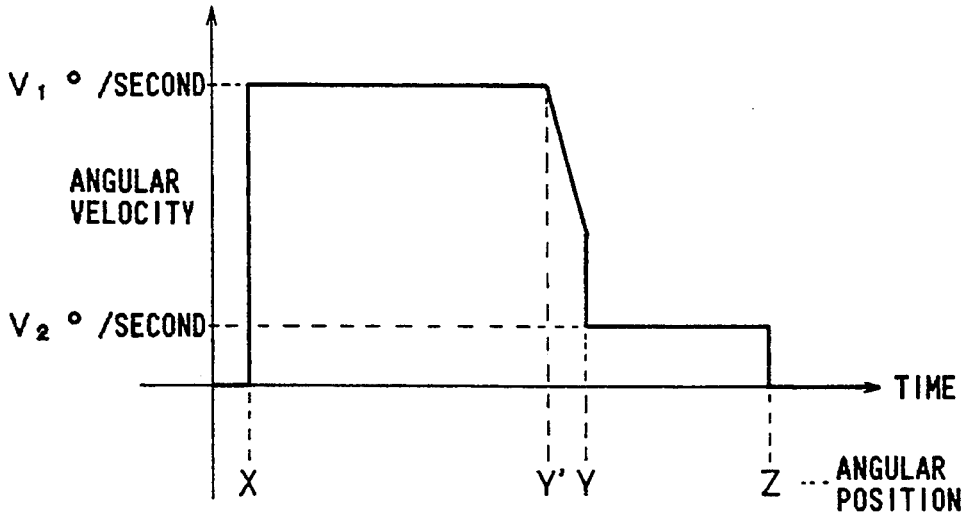
FIG. 4 is a diagram for describing the relationship between the angular velocity of a suction pad of the sheet feeding means and the angular position of the suction pad.

As shown in FIG. 3, the control circuit 20 has a CPU 60 to which a clock generator 64 is electrically connected via a frequency divider 62. Connected to the CPU 60 are a ROM 66 stored program for generating a pulse corresponding to a swingable angular range $\alpha°$ of the suction pad 14, for driving a pulse motor 18, a RAM 68 for temporarily storing data therein, and a dip switch 70 for adjusting data. The pulse motor 18 is driven at a given angular velocity in response to a drive signal output to a pulse motor driver 72 from the CPU 60. More specifically, a first angular velocity between an angular position X of the nip roller 32 and an angular position Y as shown in FIG. 1 is set to $V_1$ (°/second). Similarly, a second angular velocity between the angular position Y and an angular position Z is set to $V_2$ (°/second) lower than $V_1$ (see FIG. 4). Described specifically, for example, $V_1$ and $V_2$ are set to 180°/second and 35°/second respectively.

The operation of the sheet feeding device 10 constructed as described above will now be described below.

First, a plurality of stacked photographic light-sensitive mediums 12 is loaded into the sheet feeding device 10. Thereafter, the rotative drive source 40 of the drive mechanism 34 is energized to cause the pulleys **38*a*, 38*b*, the belts 36 and the movable member 35 to displace the rod 30 toward an uppermost sheet of the stacked photographic light-sensitive mediums 12 along the guide slot 28. Then, the uppermost photographic light-sensitive medium 12 is attracted under suction by the suction pad 14. The rotative drive source 40 is then reversed to elevate the rod 30 along the guide slot 28, so that the uppermost photographic light-sensitive medium 12 which has been attracted and held by the suction pad 14 is separated from the next photographic light-sensitive medium 12 therebelow, thereby taking out upwardly only the uppermost photographic light-sensitive medium 12 from the stacked photographic light-sensitive mediums 12**.

When the rod 30 reaches the corner of the guide slot 28, the rotative drive source 40 is de-energized, the CPU 60 supplies a drive signal to a pulse motor driver 72, thereby rotating the rotatable shaft 22 under the action of the pulse motor 18. Therefore, the suction pad 14 is swung by the guide bar 24 in the direction indicated by the arrow A at the first angular velocity $V_1$ which is of a relatively high angular velocity (see FIG. 1). Succeedingly, the nip roller 32 is moved from the angular position X to the angular position Y at the first angular velocity $V_1$. The CPU 60 then detects whether or not the nip roller 32 has reached the angular position y, based on a clock signal supplied from the clock generator 64 connected via the frequency divider 62 to the CPU 60. Thereafter, the CPU 60 supplies a given drive signal to the pulse motor driver 72 in response to a program read from the ROM 66, for example, so that the pulse motor 18 is energized to swing the suction pad 14 at the second angular velocity $V_2$ lower than the first angular velocity $V_1$. Thus, the nip roller 32 is moved from the angular position Y to the angular position Z at the second angular velocity $V_2$, where the uppermost photographic light-sensitive medium 12 is held between the nip roller 32 and the delivery roller 52. The delivery roller 52 has already been rotated by the pulse motor 42 so as to prevent the photographic light-sensitive medium 12 from slipping on the delivery roller 52.

In the present embodiment, as described above, after the uppermost photographic light-sensitive medium 12 has been attracted and held by the suction pad 14, the nip roller 32 is first moved from the angular position X to the angular position Y at the first angular velocity $V_1$ (e.g., 180°/second) which is of the relatively high angular velocity. Therefore, the uppermost photographic light-sensitive medium 12 can be fed toward the delivery mechanism 16 with a higher speed, thereby making it possible to carry out delivery operation at a higher speed with ease. Further, the nip roller 32 is moved from the angular position Y to the angular position Z with a small angular range (about 20°) being defined therebetween, at the second angular velocity $V_2$ (e.g., about 35°/second) of a lower angular velocity. Therefore, the uppermost photographic light-sensitive medium 12 is moved at a considerably low speed when it is held by the nip roller 32 and the delivery roller 52. It is thus possible to reliably prevent the photographic light-sensitive medium 12 from being subjected to scratches and fog under pressure when it is held by the nip roller 32 and the delivery roller 52. In consequence, the photographic light-sensitive mediums 12 can efficiently and highly accurately be fed one by one. Further, when the angular velocity is reduced from the first angular velocity $V_1$ to the second angular velocity $V_2$, the angular velocity may be reduced from an angular position Y' so as to reach the second angular velocity $V_2$ at the angular position Y (see FIG. 4).

The suction pad 14 is now inactivated for releasing the uppermost photographic light-sensitive medium 12. At the same time, the pulse motor 42 of the delivery mechanism 16 is energized to rotate the drum 44 in the direction indicated by the arrow B ( see FIG. 2 ) to feed the photographic light-sensitive medium 12 to a predetermined angular position by the delivery roller 52, the nip roller 32, the drum 44, and the firsthand second belts 46*a*, 46*b*. Then, the pulse motor 42 is energized to rotate the drum 44 in the direction opposite to the direction indicated by the arrow B, so that the photographic light-sensitive medium 12 held by the drum 44 is discharged along the guide plate 56 into the unillustrated automatic photographic processor or the like from the discharge port 54. At this time, s control signal supplied from a connected device such as the automatic photographic processor, etc., is supplied via the control circuit 20 to the rotative drive source 40, and the pulse motors 42, 18 so as to synchronize the speed at which the photographic light-sensitive medium 12 is transported, with the speed at which the connected device conveys the photographic light-sensitive medium 12 (see FIG. 3).

In the event, it is desired to change the turning angle $\alpha°$ of the suction pad 14, and the angular velocities $V_1$ and $V_2$, they can easily be adjusted or controlled by the dip switch 70 without changing programs therefor. The present embodiment is constructed in such a manner that the pulse motor 42 is energized to rotate the delivery rollers 52. However, the delivery roller 52 may be connected to another rotative drive sources so as to drive the delivery roller 52 in synchronism with the first belt 46*a*.

The above embodiment is an example in which the photographic light-sensitive medium 12 which have imagewisely been exposed are fed one by one to the automatic photographic processor. However, the present embodiment may also be applied even to a case in which unexposed photographic light-sensitive medium 12 are fed one by one to an image recording apparatus.

A sheet feeding device according to a second embodiment of the present invention will now be described in detail below. In the second embodiment, the same reference numerals as those employed in the sheet feeding device 10 according to the first embodiment it show the same elements of structure as those in the sheet feeding device 10 according to the first embodiment, and their detailed description will therefore be omitted.

Figure 5:
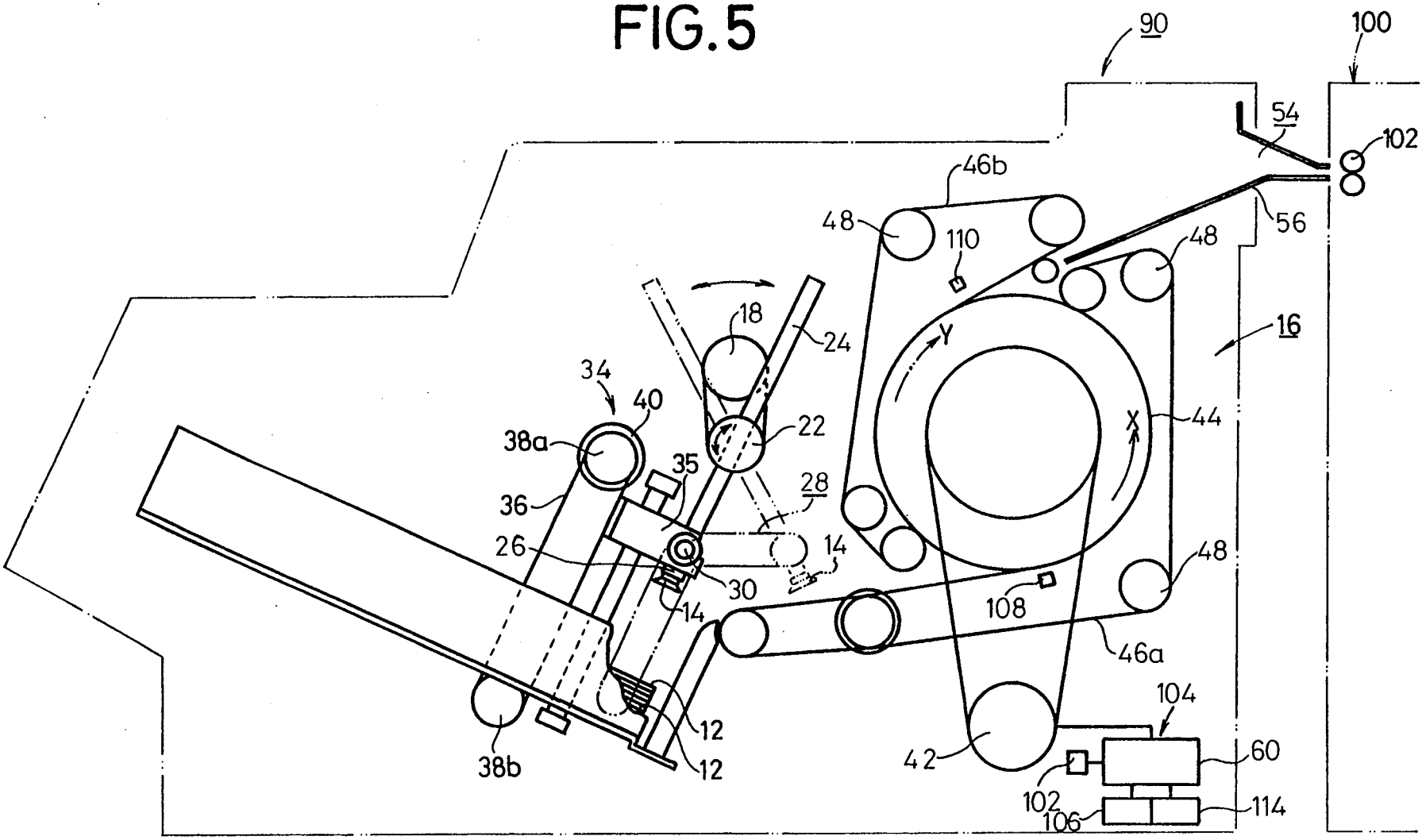
FIG. 5 is a diagram schematically showing the structure of a sheet feeding device according to a second embodiment of the present invention.

Referring to FIG. 5, designated at numeral 90 is the sheet feeding device according to the present embodiment. The sheet feeding device 90 comprises a suction cup or pad 14 for attracting and holding an uppermost sheet of stacked photographic light-sensitive mediums 12 as sheets which have imagewisely exposed, thereby taking out the uppermost photographic light-sensitive medium 12 from the stack, a delivery mechanism 16 for receiving the uppermost photographic light-sensitive medium 12 thus taken out and for delivering the medium 12 to an automatic photographic processor 100 as a succeeding station or device, a pulse motor 42 for activating the delivery mechanism 16, a control unit 104 having a ROM (memory means) 102 for storing a plurality of nominal sheet feeding or conveying speeds of the automatic photographic processor 100 as the succeeding station and a control circuit for controlling the rotational speed of the pulse motor 42, and a selecting means 106 for selecting one of the stored sheet delivery speeds synchronized with sheet conveying speed of the automatic photographic processor 100 from the ROM 102.

A first sensor 108 (e.g., a photointerrupter) for detecting the leading end of each sheet and a second sensor 110 (e.g., a photointerrupter) for detecting the tailing end of each sheet are disposed near a drum 44 of the delivery mechanism 16.

Figure 6:
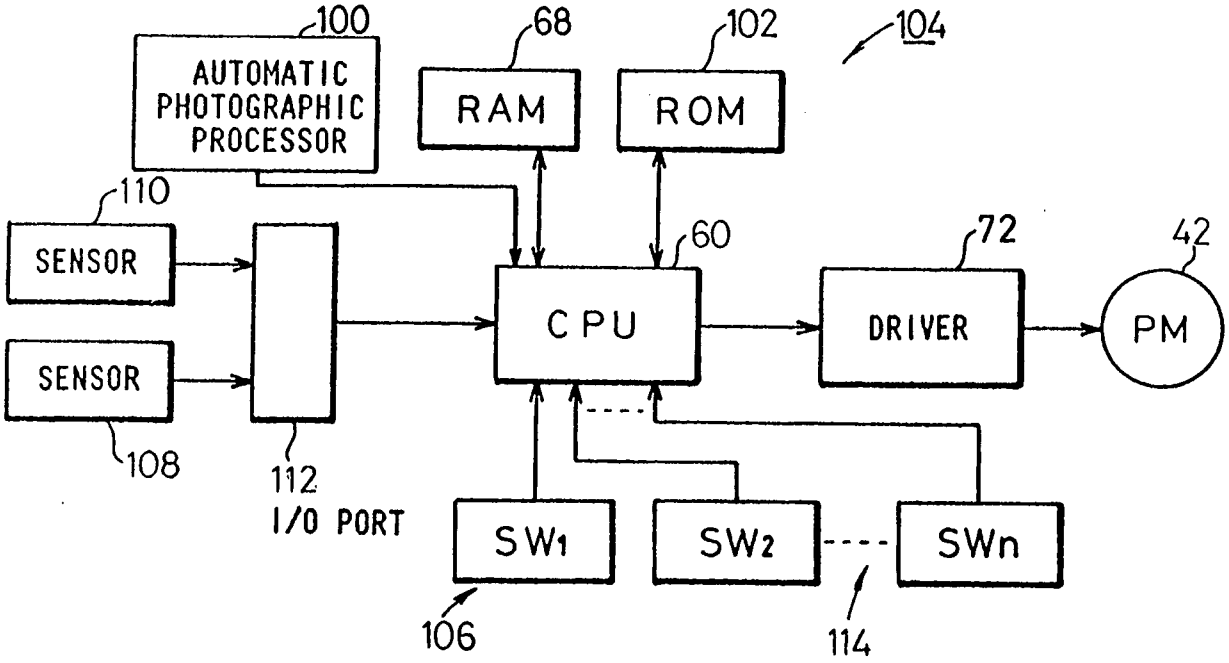
FIG. 6 is a block diagram illustrating a control unit of the sheet feeding devices.

As shown in FIG. 6, the control unit 104 comprises CPU 60 to which the ROM 102 for storing, as data, various nominal sheet conveying speeds of the automatic photographic processor 100 connected to the CPU 60 and for storing a program for generating driving pulses for a pulse-motor, etc., and a RAM 68 for temporarily storing data are connected and to which the first and second sensors 108, 110 are connected via an I/O port 112. Signals from the automatic photographic processor 100 is supplied to the CPU 60. Also connected to the CPU 60 are a dip switch $SW_1$ serving as the selecting means 106 and a plurality of dip switches $SW_2$ through $SW_n$ serving as a fine-adjustment means 114 as needed. The dip switch $SW_1$ is used to select one of the nominal conveying speeds, for example, 25 mm/second and 46 mm/second (or standard conveying speeds) of the automatic photographic processor 100 as the succeeding station to which photographic light-sensitive mediums 12 is fed. 0n the other hand, the remaining dip switches $SW_2$ through $SW_n$ are used to permit fine adjustment to a selected nominal conveying speed. The fine adjustment is carried out within ±5%, preferably ±3% with respect to the nominal conveying speed. The CPU 60 outputs drive signals to the pulse motor driver 72 so as to drive the pulse motor 42 at the adjusted speed.

The operation of the sheet feeding device 90 constructed as described above will now be described below. In this embodiment, the process for taking out-the uppermost sheet from the stacked photographic light-sensitive mediums 12 by the suction pad 14 is identical to that of the aforementioned sheet feeding device 10, and its description will therefore be omitted.

When the suction pad 14, which has attracted the uppermost photographic light-sensitive medium 12 under suction, is turned up to a position indicated by the alternate long and two short dashes line in FIG. 5, the suction pad 14 is inactivated, releasing the uppermost photographic light-sensitive medium 12, and the pulse motor 42 is energized to start feeding the uppermost photographic light-sensitive medium 12 toward the delivery mechanism 16.

When the leading end of the uppermost photographic light-sensitive medium 12 is detected by the first sensor 108, the detected signal from the first sensor 108 through the I/O port 112 is supplied to the CPU 66 and then a given drive signal is supplied to the pulse motor driver 72 according to a program read from the ROM 102 to energize the pulse motor 42 to feed the photographic light-sensitive medium 12 in the direction indicated by the arrow X at a predetermined delivery or conveying speed (e.g., at an average linear velocity of 420 mm/second). When the trailing end of the uppermost photographic light-sensitive medium 12 is detected by the second sensor 110, the pulse motor 42 is rotated in the direction opposite to the X-direction (i.e., in the direction indicated by the arrow Y) in response to a drive signal supplied from the CPU 60, thereby feeding the photographic light-sensitive medium 12 toward a discharge port, i.e., an outlet 54 along a guide plate 56, at a lower delivery seed, (e.g., 46 mm/second or 25 mm/second) as compared with the delivery speed in the direction of X. When the automatic photographic processor 100 is ready for receiving the uppermost photographic light-sensitive medium 12 an unillustrated shutter of the processor 100 is opened, and the photographic light-sensitive medium 12 is discharged into the automatic photographic processor 100 through the outlet 54 at an adjusted sheet delivery speed synchronized with the sheet conveying speed (rotational speed of a pair of rollers 102) of the automatic photographic processor 100.

In the present embodiment, as described above, a nominal conveying speed is selected by the dip switch $SW_1$ electrically connected to the CPU 60, and the nominal conveying speed is fine-adjusted by the dip switches $SW_2$ through $SW_n$ so as to meet the sheet delivery speed synchronized with an actual sheet conveying speed (rotational speed of the rollers 102) of the automatic photographic processor 100. Thus, when various types of devices such as the automatic photographic processor 100, a conveyor, etc. are used as the succeeding stations or devices, the sheet delivery speed of the sheet feeding device can accurately and easily be selected and adjusted only by setting the nominal conveying speed by use of the dip switch $SW_1$, and by fine-adjusting the nominal conveying speed thus set by use of the dip switches $SW_2$ through $SW_n$ so as to fall within, for example, ±3% with respect to the nominal conveying speed, even when the sheet conveying speed ranges from a relatively low speed to a considerably high speed (e.g., it ranges from a linear velocity of 9 mm/second to that of about 250 mm/second). In addition, the nominal sheet conveying speed can highly accurately be adjusted as compared with a conventionally-known analog adjustment process, because the nominal sheet conveying speed is set and adjusted by use of the dip s witches $SW_1$ to $SW_n$, so that the sheet delivery speed can accurately be synchronized with the sheet conveying speed of the succeeding station or device. Accordingly, the sheet feeding process can smoothly be carried out.

In the present embodiment as well, the dip switch $SW_1$ is used as the selecting means 106 for selecting one of the nominal sheet conveying speeds, whereas the dip switches $SW_2$ through $SW_n$ are used as the fine-adjusting means 114. However, a plurality of dip switches may be used as the selecting means 106, whereas the remaining dip switches may be used as the fine-adjustment means 114.

According to the present embodiment, dip switches $SW_1$ through $SW_n$ are used to select one of the nominal sheet delivery speeds and fine-adjust the sheet delivery speed thus selected. However, for example, a keyboard or the like can be used to store a desired sheet delivery speed in the RAM 68 as data. Then, the stored data from the RAM 68 can be read by the CPU 60 for controlling the drive of the pulse motor 42.

The sheet feeding device according to the present invention can bring about the following advantageous effects.

When an uppermost sheet is taken from a stack of sheets by a sheet separating means by use of a suction pad, a control circuit is activated to supply a drive signal to a drive source, e.g., a pulse motor. Thus, the feeding device is swung in a given angular range at a first angular velocity at a relatively high angular velocity, thereby making it possible to rapidly feed the uppermost sheet. In addition, the suction pad can be swung toward a delivery mechanism at a decreasing speed, thereby making it possible to smoothly deliver the uppermost sheet attracted by the suction pad under suction to the delivery mechanism. It is therefore possible to carry out a sheet feeding process at a high speed and to effectively prevent the sheet from being subjected to scratches and fog under pressure or the like upon feeding of the sheet to the delivery mechanism.

According to the present invention as well, a control unit is activated to cause a drive source, e.g., a pulse motor to accurately synchronize a sheet delivery speed of an uppermost sheet delivered to a delivery mechanism by a feeding device with an actual sheet conveying speed of the succeeding station or device, by selecting a nominal sheet conveying speed by a selecting means and by fine-adjusting the nominal sheet conveying speed by a fine-adjusting means, to deliver the uppermost sheet toward the succeeding station. It is therefore possible to easily and accurately synchronize a sheet delivery speed of the delivery mechanism with a wide range of sheet conveying speeds of the succeeding device. As a result, any sheet delivery speed can be adjusted with accuracy and over a wide range, and a variety of devices can hence be used as the succeeding device or station to be connected. In addition, the sheets can smoothly be fed one by one to the succeeding station.

Having now fully described the invention, it will be apparent to those skilled in the art that many changes and modifications can be made without departing from the spirit or scope of the invention as set forth herein.

What is claimed is:

1. A sheet feeding device for feeding sheets, one by one, from a stack of sheets, said device comprising:

sheet separating means for attracting and holding an uppermost sheet of a stack of sheets, thereby withdrawing said uppermost sheet from the stacked sheets, said sheet separating means being swingable through a given angular range;

delivering means for receiving said uppermost sheet from said sheet separating means and for delivering said uppermost sheet to a succeeding station, said delivering means comprising a drum, a first belt and a second belt each in contact with said drum and drive means for driving said drum, wherein said drum and said first and second belts rotate in a first direction to roll in said sheet therebetween, and then said drum and said second belt rotate in a second direction to roll out said sheet to deliver said sheet to the succeeding station;

a drive source for activating said delivering means;

control means having a memory for storing data relating to a plurality of nominal sheet conveying speeds of said succeeding station, and a control circuit coupled to said drive source so as to control the rotational speed of said drive source; and means for selecting said stored nominal sheet conveying speeds from said memory.

2. A sheet feeding device according to claim 1, wherein said selecting means is a dip switch.

3. A sheet feeding device according to claim 1, further including means for fine-adjusting said nominal sheet conveying speed selected by said selecting means.

4. A sheet feeding device according to claim 3, wherein said fine-adjusting means is at least one dip switch.

5. A sheet feeding device for feeding sheets, one by one, from a stack of sheets, said device comprising:

sheet separating means for attracting and holding an uppermost sheet of a stack of sheets, thereby withdrawing said uppermost sheet from the stacked sheets, said sheet separating means being swingable through a given angular range;

delivering means for receiving said uppermost sheet from said sheet separating means and for delivering said uppermost sheet to a succeeding station, said delivering means comprising a drum, a first belt and a second belt each in contact with said drum, a first detecting means for detecting the leading end of said sheet, a second detecting means for detecting the trailing end of said sheet and drive means for driving said drum, wherein said first and second belts transport said sheet in a first direction at a first speed in response to the first detecting signal by said first detecting means, and then said second belt transports said sheet in a second direction at a second speed, which is different from said first speed, in response to the second detecting signal by said second detecting means;

a drive source for activating said delivering means;

control means having a memory for storing data relating to a plurality of nominal sheet conveying speeds of said succeeding station, and a control circuit coupled to said drive source so as to control the rotational speed of said drive source; and means for selecting said stored nominal sheet conveying speeds as said first and second speeds from said memory.

* * * * *